US007179174B2

(12) United States Patent
Chang

(10) Patent No.: US 7,179,174 B2
(45) Date of Patent: Feb. 20, 2007

(54) BILLIARD CUE WITH WEIGHT DEVICES

(76) Inventor: Jung-Shih Chang, No. 32, Lane 25, Li Min Street, Ta Li City, Taichung Hsien (TW)

( * ) Notice: Subject to any disclaimer, the term of this patent is extended or adjusted under 35 U.S.C. 154(b) by 0 days.

(21) Appl. No.: 11/167,598

(22) Filed: Jun. 28, 2005

(65) Prior Publication Data

US 2006/0293111 A1 Dec. 28, 2006

(51) Int. Cl.
*A63D 15/08* (2006.01)

(52) U.S. Cl. ..... 473/47; 473/46

(58) Field of Classification Search ..... 473/44–51
See application file for complete search history.

(56) References Cited

U.S. PATENT DOCUMENTS 835,489 A * 11/1906 Adorjan ..... 473/47
1,705,353 A * 3/1929 Barrett ..... 473/47
3,232,613 A * 2/1966 Laube, Jr. ..... 473/47
3,342,489 A * 9/1967 Waldo ..... 473/47
5,112,046 A * 5/1992 Thorpe ..... 473/47
6,712,712 B2 * 3/2004 Bourque ..... 473/46
2004/0142754 A1 * 7/2004 McKevitt et al. ..... 473/44
2005/0043107 A1 * 2/2005 Kuo ..... 473/44

* cited by examiner

*Primary Examiner*—Mark S. Graham
(74) *Attorney, Agent, or Firm*—Browdy and Neimark, PLLC

(57) ABSTRACT

A billiard cue includes a forward body defined by a first constantly tapered configuration securely mounted to a backward body defined by a second constantly tapered configuration. A cue tip is attached to an open end of the forward body and a butt cap is attached to an open end of the backward body. The backward body has a longitudinal threaded bore with an opening thereof at the open end of the backward body. At least a threaded weight device is received and engaged in the bore of the backward body from the opening in such a way that the location of the weight device can be adjusted independently.

15 Claims, 5 Drawing Sheets

BILLIARD CUE WITH WEIGHT DEVICES

BACKGROUND OF THE INVENTION

1. Field of the Invention

The present invention relates, in general, to billiard cues and, more specifically, to billiard cues with weight devices therein to adjust he location of the center of gravity thereof.

2. Description of the Art

U.S. Pat. No. 5,112,046 discloses a billiard cue of which the location of the center of gravity is adjustable. As shown in FIG. 5 of the patent specification, the location of the center of gravity of the prior art billiard cue is adjusted by some weight devices received in the butt end thereof.

It is no question that the location of the center of gravity of the billiard cue can be adjustable when the weight devices are inserted into the cue body. But there have some defects of such a prior art billiard cue. For example, the first is that the location of the center of gravity of the cue can only be adjusted from the butt end thereof for the reason that the first weight device must be threaded on the butt cap, as shown on FIG. 5. The second is that the location of the weight devices can not be adjusted independently because each weight device must be connected by next one. In addition, for not being connected to the cue body, the weight devices would fall off from the cue body easily.

Thus, it would be desirable to provide a billiard cue having a plurality of areas to receive weight devices to enable the location of the center of gravity of the cue being adjusted not only from the butt end thereof but also from the cue body. It would also be desirable to provide a billiard cue having weight devices that each one of them is connected to the cue body independently and not connected by next one so that each weight device is positioned in such a way that the location of it can be adjusted independently, and it would not fall off from the cue body. It would also be desirable to provide a billiard cue having weight devices with a specific structure to enable each one of them being fast and easily received in the cue body.

SUMMARY OF THE INVENTION

The present invention is an improved billiard cue which includes a forward body and a backward body securely mounted to the forward body. The forward or backward body provides a longitudinal bore with an opening at one end thereof. At least a weight device is received in the bore from the opening in such a way that the location thereof can be adjusted independently.

In a first preferred embodiment, the billiard cue includes a forward body defined by a first constantly tapered configuration securely mounted to a backward body defined by a second constantly tapered configuration, wherein the forward and backward bodies are coaxially aligned along a common axis when the forward body is secured to the backward body. A cue tip is attached to an open end of the forward body and a butt cap is attached to an open end of the backward body. The backward body has a longitudinal threaded bore with an opening extending from the open end thereof for at least a predetermined distance along the common axis. At least a threaded weight device is received and engaged in the bore of the backward body from the opening in such a way that the location of the weight device can be adjusted independently.

In a second preferred embodiment, the billiard cue includes a forward body and a backward body securely mounted to the forward body. The backward body has a handle portion and a shaft portion securely mounted to the handle portion. The shaft portion has a longitudinal threaded bore extending with an opening from one end thereof for at least a predetermined distance along the axis of the shaft portion. At least a threaded weight device is received and engaged in the bore of said shaft portion.

In a third preferred embodiment, the billiard cue includes a forward body and a backward body securely mounted to the forward body. The backward body has a handle portion and a shaft portion securely mounted to the handle portion. The shaft and handle portions each has a longitudinal threaded bore with an opening extending from one end thereof for at least a predetermined distance along the axis thereof. At least a threaded weight device is received and engaged in the bore of the shaft or handle portion.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figure 1:
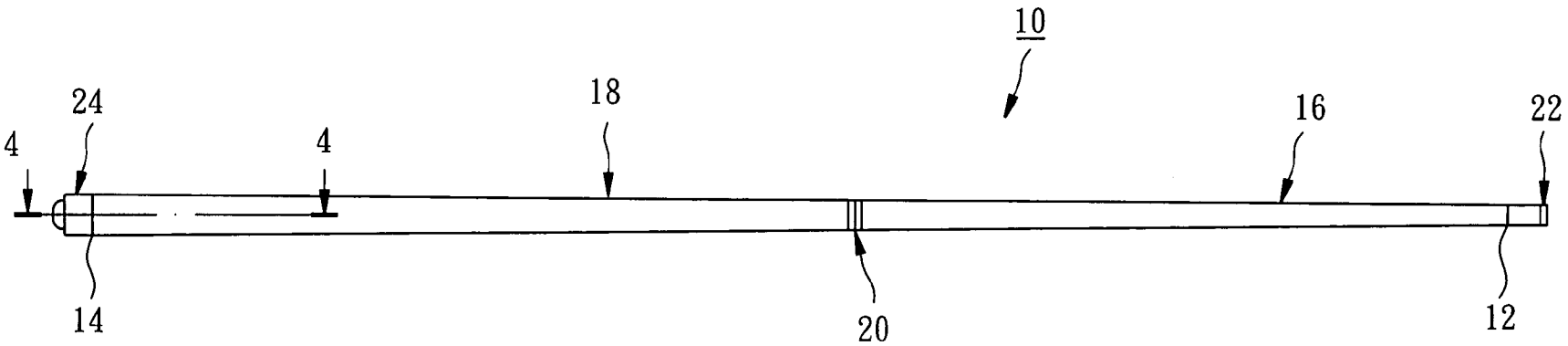
FIG. 1 is a side elevational view of a billiard cue according to a first preferred embodiment of the present invention.
Figure 3:
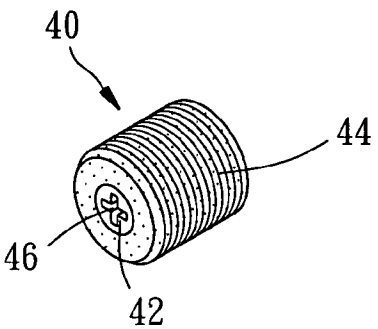
FIG. 3 is a perspective view of the weight device of the billiard cue of FIG. 1.
Figure 2:
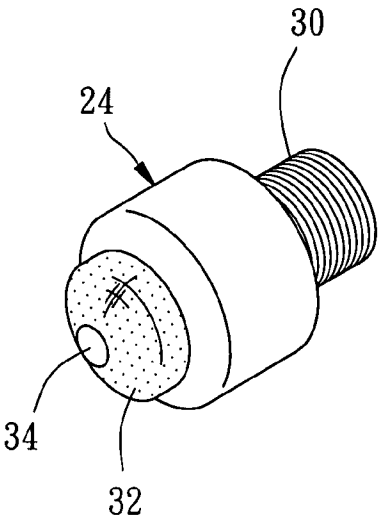
FIG. 2 is a perspective view of the butt cap of the billiard cue of FIG. 1.
Figure 4:
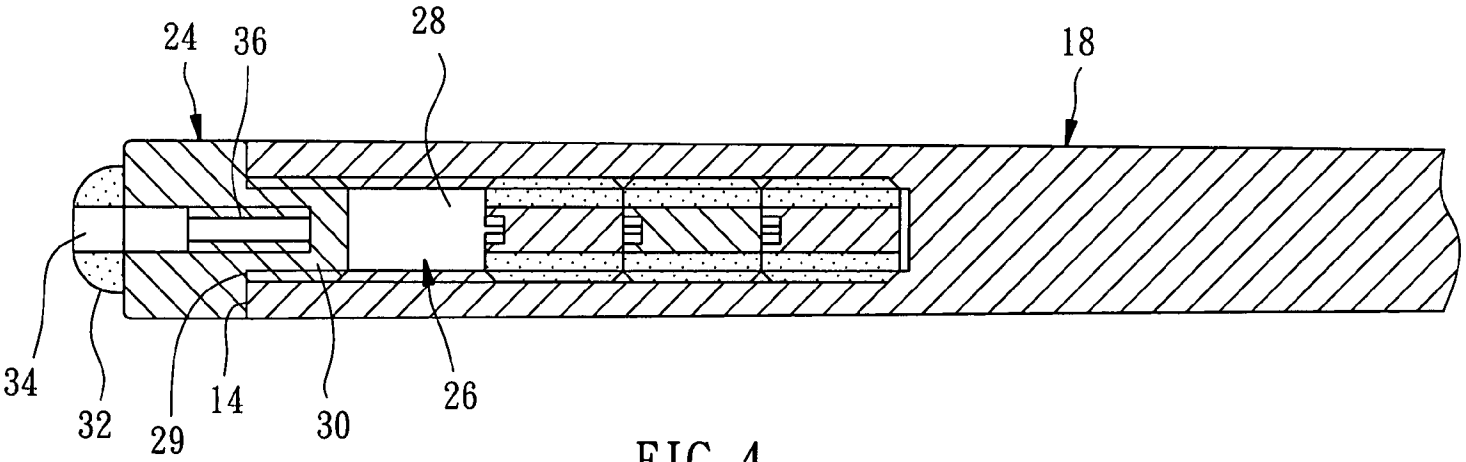
FIG. 4 is a sectional view of the billiard cue of FIG. 1 along the line 4—4 in FIG. 1.

Referring firstly to FIG. 1 to FIG. 4 of the drawings, a billiard cue 10 includes a forward body 16 having a first constantly tapered configuration and a backward body 18 having a second constantly tapered configuration. The forward body 16 and the backward body 18 are coaxially aligned along a common axis when the forward body 16 is secured to the backward body 18 by a connector 20. A cue tip 22 is attached to the open end 12 of the forward body 16. A butt cap 24 is attached to the open end 14 of the backward body 18.

The backward body 18 provides a longitudinal threaded bore 28 which is extending from an opening 29 thereof at the open end 14 for at least a predetermined distance along the common axis. The butt cap 24 is cylinder with a bolt 30 at one end, an elasticity bumper 32 at the other end, and a through hole 34 with a threaded portion 36. The bolt 30 of the butt cap 24 is received in the bore 28 from the opening 29 and engaged therein.

In this embodiment, there are three weight devices 40 respectively received in the bore 28 of the backward body 18. Of course, the number of the weight device is depended on the need of the users. The weight device 40 is a cylinder having a hard core 42 made of metal or other hard materials and a threaded resilient sleeve 44 made of plastic materials and wrapping the hard core 42. The core 42 has at one end a depression 46 shaped "+" or "−" for being driven by a driver.

As mentioned, when there is need to adjust the location of the center of gravity of the billiard cue 10, the user first disconnects the butt cap 24 by hand and then puts the weight devices 40 into the bore 28 from the open thereof and adjusts the location thereof to a best position by a driver and finally reattaches the butt cap 28 to the butt end 14 of the backward body 18.

Figure 5:
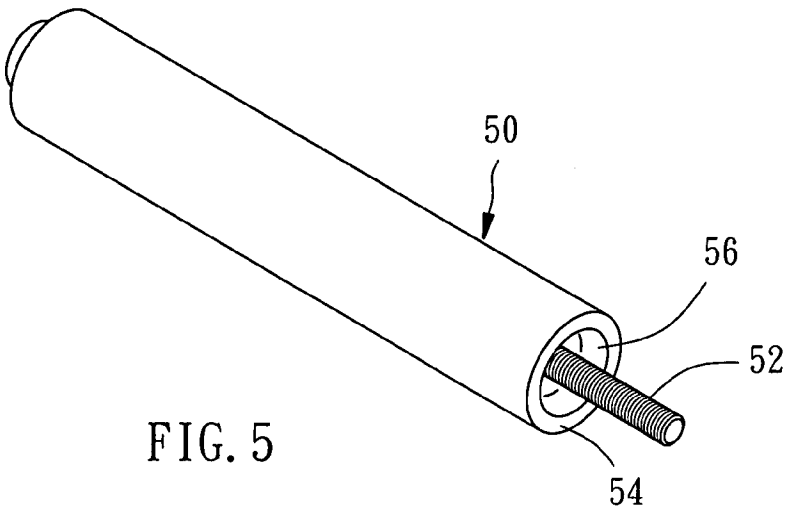
FIG. 5 is a perspective view of the extending device of the billiard cue of FIG. 1.
Figure 6:
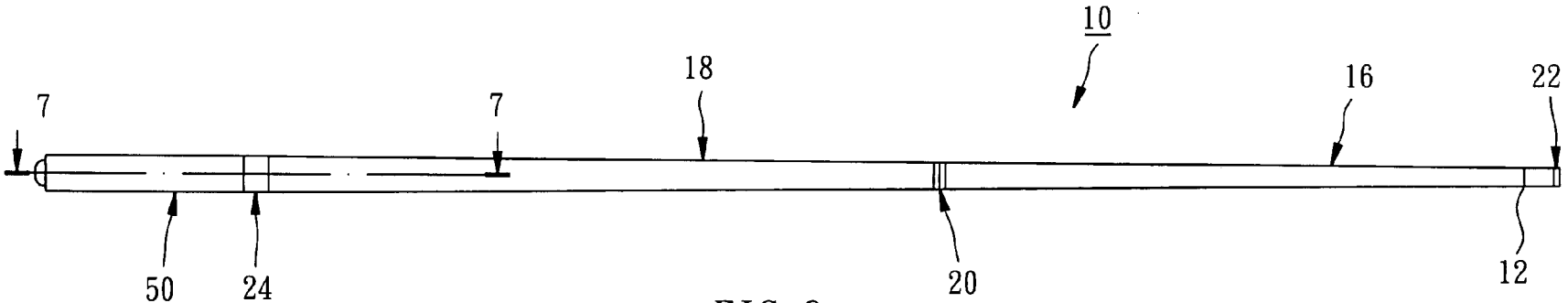
FIG. 6 is a side elevational view of the billiard cue of FIG. 1 connected with the extending device of the FIG. 5.
Figure 7:
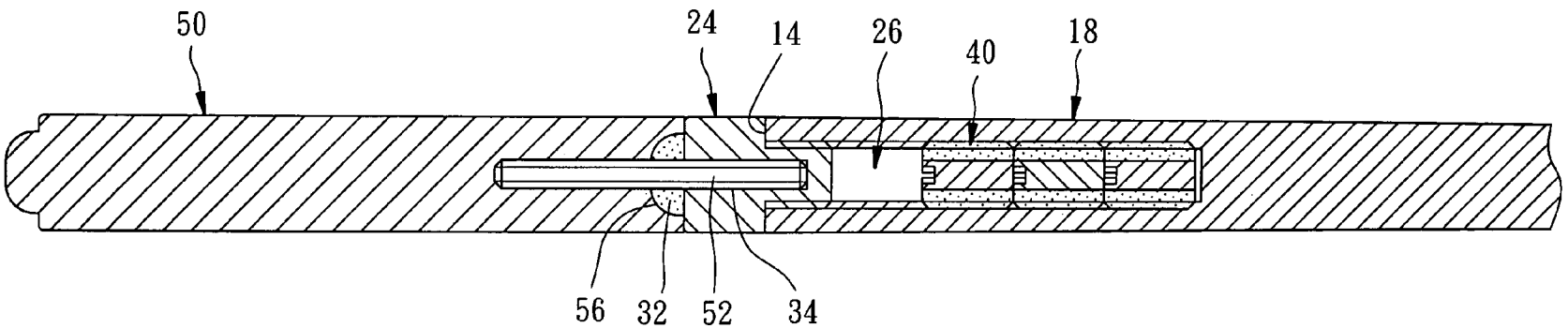
FIG. 7 is a sectional view of the billiard cue of FIG. 6 along the line 7—7 in FIG. 6.

Referring now to FIG. 5 to FIG. 7 of the drawings, the billiard cue 10 can be extended by an extending device 50. The extending device 50 is a stick having a predetermined length and with a bolt 52 at one end and a concave 56 provided on the surface of the end. When there is need to extend the length of the billiard cue 10, the user can attach the extending device 50 to the backward body 18 by piercing the bolt 52 into the hole 34 of the butt cap 24 and engaging it in the threaded potion 36 thereof. As the extending device 50 is attached to the butt cap 24, the bumper 32 of the butt cap 24 is received in the concave 56 of the extending device 50.

Figure 8:
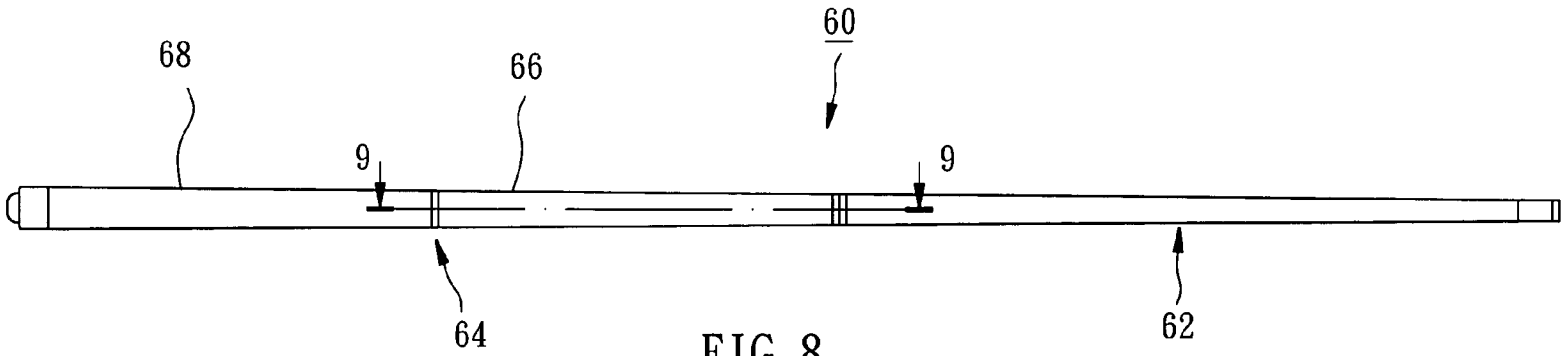
FIG. 8 is a side elevational view of a billiard cue according to a second preferred embodiment of the present invention.
Figure 9:
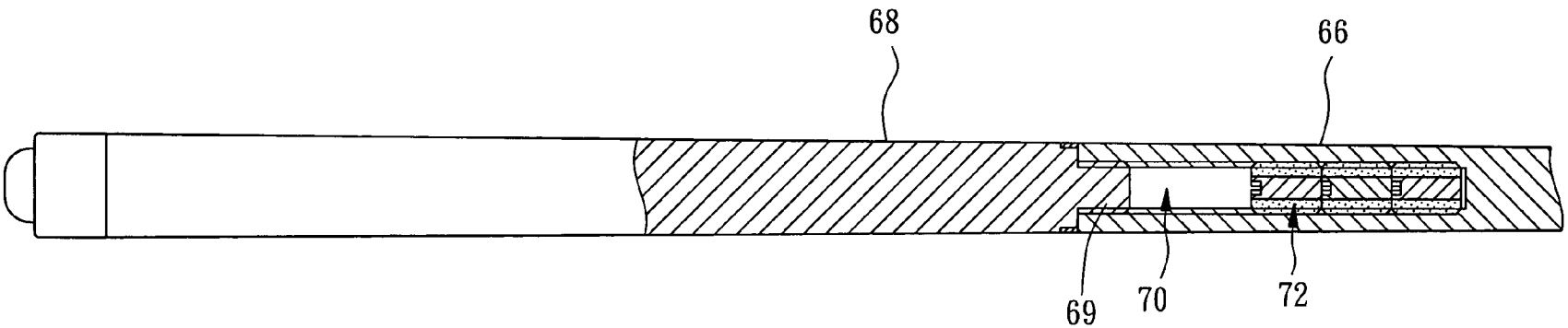
FIG. 9 is a sectional view of the billiard cue of FIG. 8 along the line 9—9 in FIG. 8.

According to the teaching of the present invention, there can be a second preferred embodiment shown in FIG. 8 and FIG. 9. The billiard cue 60 is similar to the billiard cue 10 and combined by a forward body 62 and a backward body 66. The difference is that the backward body 66 of the billiard cue 60 is constructed by a shaft 66 and a handle 68 connected to the shaft 66 by a threaded end 69 thereof. The shaft 66 has a threaded bore 70 extending from the end used to connect the shaft 66 to the handle 68 along the axis thereof. There are three weight devices 72 received in the bore 70.

Figure 10:
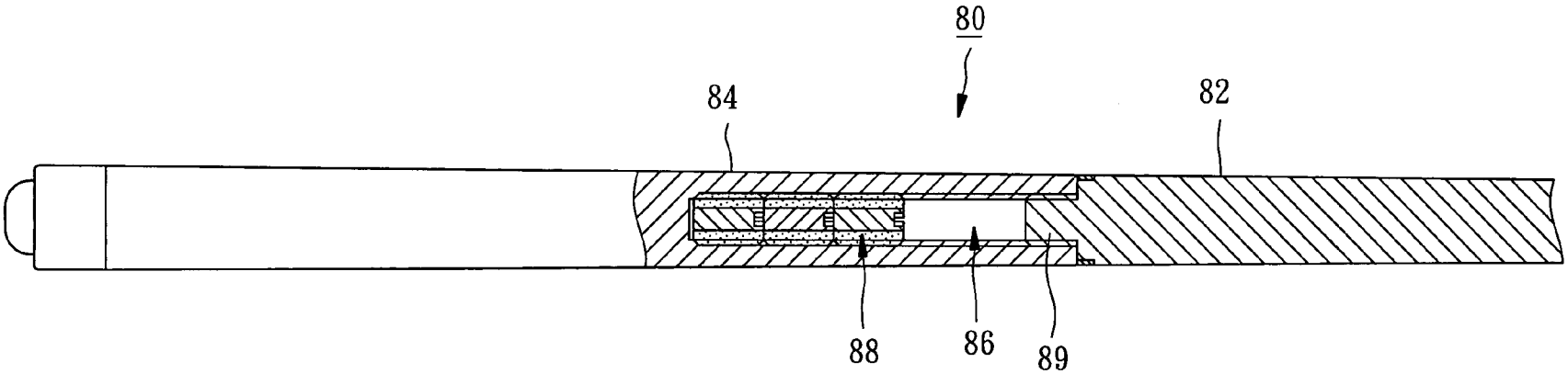
FIG. 10 a sectional view of a billiard cue according to a third preferred embodiment of the present invention along the line similar to FIG. 9.

According to the teaching of the present invention, there can be a third preferred embodiment shown in FIG. 10. The billiard cue 80 is similar to the billiard cue 60. The backward body of the billiard cue 80 is constructed by a shaft 82 and a handle 84 connected to the shaft 82 by a threaded end 89 of the shaft 82. The difference between the billiard 60 and the billiard cue 80 is that the handle 84 of the billiard cue 80 has a threaded bore 86 extending from the end used to connect the handle 84 to the shaft 82 along the axis thereof. And the weight devices 88 are received in the bore 86.

Figure 11:
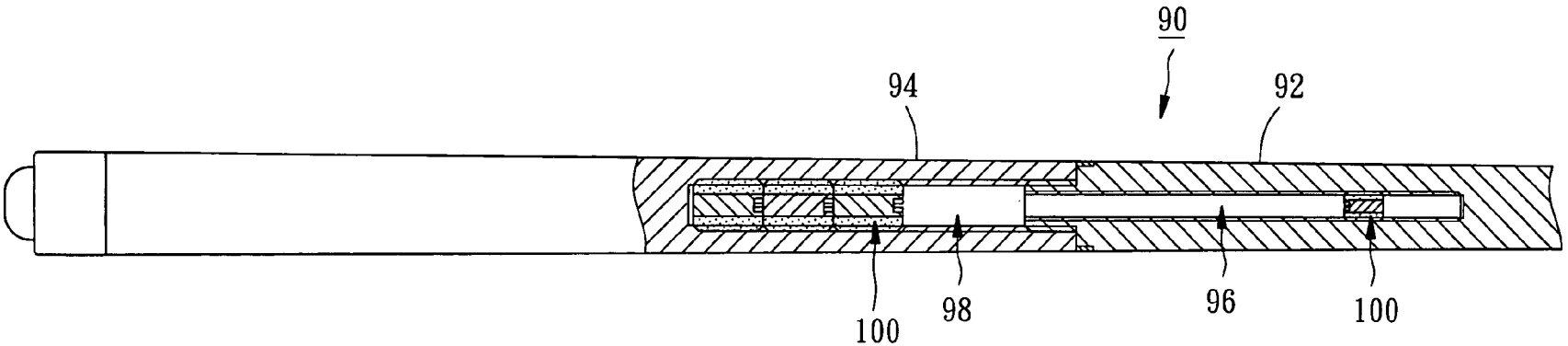
FIG. 11 a sectional view of a billiard cue according to a fourth preferred embodiment of the present invention along the line similar to FIG. 9.

According to the teaching of the present invention, there still can be a fourth preferred embodiment shown in FIG. 11. The billiard cue 90 is similar to the billiard cue 60 and 80. The difference between them is that the shaft 92 and the handle 94 of the billiard cue 90 each have a threaded bore 96 and 98. The diameter of the threaded bore 96 is smaller than that of the threaded bore 98. And the weight devices 100 are received in the bore 96 and 98.

As mentioned above, the billiard cue constructed according to the present invention has a number of characteristics, like as:

1. the butt cap is independent with the weight device;
2. the weight devices are independent with each other;
3. the cue body has several areas to receive the weight devices; and
4. each of the weight devices is engaged with the cue body independently and the location thereof in the cue body can be adjusted according to the need of the users.

Whereby the characteristics as mentioned above, the location of the center of gravity of the billiard cue can be adjusted not only from the butt end thereof but also from the cue body. And the users can adjust the location of each weight device in the cue body independently as their need. Furthermore, for having the specific structure of the butt cap, the length of the billiard cue can be extended fast and easily.

While the description had been concerned with a particular embodiment of the invention, it is to be understood that many modifications and variations in the construction and arrangement thereof may be provided for without departing from the spirit and scope of the invention or sacrificing any of its advantages. The invention is therefore considered as including all such possible modifications and variations coming within the legitimate and valid scope of the appended claims.

What is claimed is:

1. A billiard cue comprising:

a forward body defined by a first constantly tapered configuration securely mounted to a backward body defined by a second constantly tapered configuration, wherein said forward body and said backward body are coaxially aligned along a common axis when said backward body is secured to the forward body;

a cue tip attached to an open end of said forward body;

a butt cap attached to an open end of said backward body;

said backward body having a longitudinal threaded bore extending from the open end thereof for at least a predetermined distance along the common axis; and at least a threaded weight device received and engaged in the bore of said backward body, wherein said weight device includes a hard core and a threaded resilient sleeve wrapping said core corresponding to said longitudinal threaded bore.

2. The billiard cue of claim 1 wherein said weight device having an end with a depression shaped to be driven by a tool.

3. The billiard cue of claim 1 wherein said core has an end with a depression shaped to be driven by a tool.

4. The billiard cue of claim 1 wherein said butt cap has a bolt protruding from one end thereof to be received and engaged in an opening of said threaded bore of said backward body.

5. The billiard cue of claim 4 wherein said butt cap has a threaded hole extending from one end thereof for a predetermined distance along the axis of said butt cap and the billiard cue further comprising an extending device having a bolt protruding from one end thereof, the bolt of said extending device received and engaged in the threaded hole of said butt cap when said extending device is connected thereto.

6. The billiard cue of claim 5 wherein said butt cap has a bumper attached to another end thereof and said extending device has a concave provided on one end thereof for receiving said bumper when said extending device is connected to said butt cap.

7. A billiard cue comprising:

a forward body defined by a first constantly tapered configuration securely mounted to a backward body defined by a second constantly tapered configuration, wherein said forward body and said backward body are coaxially aligned along a common axis when said backward body is secured to the forward body;

a cue tip attached to an open end of said forward body;

a butt cap attached to an open end of said backward body;

said backward body including a handle portion and a shaft portion securely mounted to said handle portion;

said shaft portion having a longitudinal threaded bore extending from one end thereof for at least a predetermined distance along the axis of said shaft portion; and at least a threaded weight device received and engaged in the bore of said shaft portion;

wherein said weight device includes a hard core and a threaded resilient sleeve wrapping said core corresponding to said longitudinal threaded bore.

8. The billiard cue of claim 7 wherein said weight device has an end with a depression shaped to be driven by a tool.

9. The billiard cue of claim 7 wherein said core has an end with a depression shaped to be driven by a tool.

10. A billiard cue comprising:

a forward body defined by a first constantly tapered configuration securely mounted to a backward body defined by a second constantly tapered configuration, wherein said forward body and said backward body are coaxially aligned along a common axis when said backward body is secured to the forward body;

a cue tip attached to an open end of said forward body;

a butt cap attached to an open end of said backward body;

said backward body including a handle portion and a shaft portion securely mounted to said handle portion;

said handle portion having a longitudinal threaded bore extending from one end thereof for at least a predetermined distance along the axis of said handle portion; and at least a threaded weight device received and engaged in the bore of said shaft portion;

wherein said weight device includes a hard core and a threaded resilient sleeve wrapping said core corresponding to said longitudinal threaded bore.

11. The billiard cue of claim 10 wherein said weight device has an end with a depression shaped to be driven by a tool.

12. The billiard cue of claim 10 wherein said core has an end with a depression shaped to be driven by a tool.

13. A billiard cue comprising:

a forward body defined by a first constantly tapered configuration securely mounted to a backward body defined by a second constantly tapered configuration, wherein said forward body and said backward body are coaxially aligned along a common axis when said backward body is secured to the forward body;

a cue tip attached to an open end of said forward body;

a butt cap attached to an open end of said backward body;

said backward body including a handle portion and a shaft portion securely mounted to said handle portion;

said shaft portion having a first longitudinal threaded bore extending from one end thereof for at least a predetermined distance along the axis of said shaft portion;

said handle portion having a second longitudinal threaded bore extending from one end thereof for at least a predetermined distance along the axis of said handle portion; and at least one threaded weight device received and engaged in each of the first or second bore;

wherein each said weight device includes a hard core and a threaded resilient sleeve wrapping said core respectively corresponding to said first longitudinal threaded bore and said second longitudinal threaded bore.

14. The billiard cue of claim 13 wherein said weight device has an end with a depression shaped to be driven by a tool.

15. The billiard cue of claim 14 wherein said core has an end with a depression shaped to be driven by a tool.

* * * * *